United States Patent [19]

Wilson et al.

[11] 4,366,748

[45] Jan. 4, 1983

[54] AIR DIFFUSER

[75] Inventors: Kent D. Wilson, Chatsworth; John M. Hoffman, Woodland Hills, both of Calif.

[73] Assignee: Air Components, Inc., Chatsworth, Calif.

[21] Appl. No.: 232,388

[22] Filed: Feb. 6, 1981

[51] Int. Cl.[3] ..... F24F 13/08

[52] U.S. Cl. ..... 98/40 D; 98/40 V

[58] Field of Search ..... 98/40 R, 40 D, 40 V; 220/3.2, 3.3, 3.8, 4 R, 75; 228/142; 29/157 R; 312/257 SM, 242

[56] References Cited

U.S. PATENT DOCUMENTS

| | | | |
|---|---|---|---|
| Re. 25,216 | 8/1962 | Kennedy | 98/40 D |
| 1,537,325 | 5/1925 | Smith et al. | 220/3.8 |
| 1,582,541 | 4/1926 | Ringer | 220/4 R |
| 2,822,741 | 2/1958 | Kennedy | 98/40 D |
| 3,559,560 | 2/1971 | Trahan | 98/40 D |
| 4,034,659 | 7/1977 | Raider | 98/40 D |
| 4,243,282 | 1/1981 | Oensen | 312/258 |
| 4,266,470 | 5/1981 | Schroeder et al. | 98/40 R |

*Primary Examiner*—Albert J. Makay
*Assistant Examiner*—Harold Joyce
*Attorney, Agent, or Firm*—Poms, Smith, Lande & Rose

[57] ABSTRACT

The diffuser is constructed primarily of lightweight, roll formed, channeled sheet metal bent into a square by cutting the top and bottom margins at the bends. Each of the corners is then riveted. The top wall is molded figerglass which can be easily cut to form a central opening of different diameters. The fiberglass is held between the bent margins of the sidewall and a bracket riveted to the sidewall. The bottom wall is perforated and riveted to the sidewall. A radial deflector having a central portion and arms extending outward is riveted through one of the perforations in the bottom wall. Each arm has a flat portion and bent up portion. The flat portion is spaced from the bottom wall by means of small resilient tabs.

9 Claims, 3 Drawing Figures

AIR DIFFUSER

BACKGROUND OF THE INVENTION

Diffusers for air conditioning, ventilation and heating systems display a number of characteristics. They should be easily constructed, generate a dispersed air pattern, be quiet, and be easily installed in a ceiling by simple connection to the ducted work. The primary purpose of the diffusers is for air distribution, and a 360° air pattern is usually desirable. In constructing diffusers, they should be generally airtight on the sides so that no air is lost in the ceiling. Lightweight construction saves material and allows for ease of installation.

A number of attempts have been made to improve one or more of these aspects. One problem that has occurred is in the construction of a 360° deflector. Preferably, it will be extremely inexpensive to manufacture, and it either must attach to the sides of the diffuser or attach to a perforated bottom wall that is attached to the sidewalls. If it is attached to a bottom wall, vibration between the deflector and the bottom wall may be a problem. It is therefore an object of the present invention to provide and to disclose a deflector that overcomes these problems by using resilient spacers between the bottom wall and the deflector to prevent vibrations from being transmitted to the bottom wall. These spacers also improve the air distribution by providing a small space between the deflector and the bottom wall uncovering perforations.

The top of the diffuser is connected to the ducting. The top wall in prior art diffusers was usually metal, and each would have to be purchased with the correct opening for the duct. If not, the installer would have to use metal cutting tools to widen the opening to accommodate ducting of different diameters. Metal, moreover, is heavy. One of the objects, therefore, of the present invention is to provide a top wall of lighter weight material which can be cut on site. The present invention uses molded fiberglass, which is also a good thermal and sound insulator. To prevent particles of the fiberglass from being removed during installation and also to minimize the contact with the fiberglass by the installer, the fiberglass may be covered with foil. Foil also makes an excellent surface for printing locating indicia for locating the opening for connection to the ducting. It is an object of the present invention to disclose and provide a diffuser having these properties and solving the problems.

Another problem in air diffusers is to minimize construction costs. Thin sheet metal is lightweight and can be easily formed using low cost hand tools such as tin snips and riveters. One of the objects of the present invention is to disclose and provide an air diffuser of low cost construction, but which when constructed secures the fiberglass top wall within the diffuser so that it will not be dislodged in cutting an opening for insertion of the ducting.

Diffusers having perforated bottom walls offer certain advantages over other types of diffusers for certain application. The air stream is broken into many small streams such that these smaller streams mix well with the room air as shortly after passing through the diffuser. Larger volumes of air can be exchanged without drafts. A perforated screen with a free area of about 51% has been found to be rigid with sufficient free area to pass air without an objectionable pressure drop. Ohe of the objects of the invention is to disclose and provide a diffuser that utilizes the perforated bottom with a radial deflector and that also has the simplified construction of the present invention.

Because of the uncomplicated construction of the deflector, the angles may be changed during construction or even in the field and it is an object of the present invention to disclose and provide for this feature. This feature may be important to modify the air patterns. For example, in rooms with high ceilings, it may be desirable to have a tighter distribution pattern so that a flow of air will reach closer to the ground. An angle change may modify this result.

Improved air distribution can also be accomplished using a perforated deflector that further breaks up the main air stream, and it is an object to disclose and provide such a deflector.

A further object is to disclose and provide a sturdy unit of lightweight construction. The present diffuser has a member of molded fiberglass. Although molded fiberglass has been used previously, it was not protected such that it could be easily damaged during shipping and installation. The useful fiberglass is protected in the present invention and the unit is extremely sturdy yet lightweight.

The present invention meets the previously stated objects, and it also meets other objects that, although not specifically listed as objects, are evident from the description of the invention.

SUMMARY OF THE INVENTION

These and other objects are accomplished in the following manner. The air diffuser has a perimetric sidewall, a perforated bottom wall or screen attached to the bottom of the sidewall, and a top wall attached to the top of the sidewall. The sidewall, bottom and top walls form a box-like structure. Such a diffuser has been improved by having the top wall of rigid, insulating material capable of securing ducting to an opening through the material. This rigid material is preferably molded fiberglass which may have a foil top to improve thermal and accoustical properties, to prevent damage from condensation, and to protect the insulating material. It also provides a surface for stencils for printing.

The sidewall is formed of a strip of sheet metal bent along its longitudinal edges or roll formed to form top and bottom margins. The sheet metal is bent along its width at three locations to form edges, and the two ends of the strip are brought together so that the sidewall forms a square or rectangle. The longitudinal edges are cut at the perferred location of the bends at the width to permit bending of the strip along the width. The surfaces of adjacent margins at the cuts are positioned over or under and in contact with the surface of the portion of the margin on the other side of the cut, and a rivet or other fastener attaches both surfaces together. This rivet, located near the bends secures the sidewalls in their desired shape.

A bracket or other support means is located near the top of each portion of the sidewall, and this support means cooperates with the top sidewall margin to secure the fiberglass top wall in the diffuser. The corners of the margins also contact the inside of the sidewall to assist in holding the structure rigid. Because the sidewall is continuous about three sides, no air can leak through those sides, and with a short additional length of sheet metal at the fourth side, which is then bent under the first side, the fourth edge is also sealed.

The bottom wall is a perforated metal screen with its sides bent upward such that the dimensions of the bottom are slightly greater than the dimensions of the projection of the sidewall, and the bottom wall is attached to the sidewalls by rivets or other fasteners extending through the bent up portion of the bottom wall and the sidewalls. The rivets that attach the bottom wall may also hold seismic tabs for additional support of the diffuser. These tabs are required by certain building codes in areas where earthquakes are more common.

Another feature of the present invention is the new deflector. The deflector is attached to the bottom wall of the diffuser for deflecting air as it exits the diffuser. The deflector has a plurality of arms extending radially out from a central area. Each arm has a flat portion generally parallel to the bottom wall and a bent up portion for deflecting air. The deflector is connected to the bottom perforated wall by means of a connecting member or rivet through the central portion of the deflector and a perforation in the bottom wall. Resilient means, which may be rubber tabs, are mounted between the flat portions of the arm and the perforated bottom to reduce contact between the arm and the bottom so that the deflector does not completely cover the perforations under the arms permitting some air to pass through the perforations under the arms to change the air flow through the diffuser. The angle of the bend of the arms is acute to a radius from the center of the deflector for spreading the air flow out from the diffuser. The angle of the flat portion to the bent up portion of the deflector arms can be adjusted to modify the air distribution pattern.

BRIEF DESCRIPTION OF THE DRAWINGS

The three drawing figures on one sheet of drawings are as follows.

DETAILED DESCRIPTION OF THE PREFERRED EMBODIMENT

Figure 1:
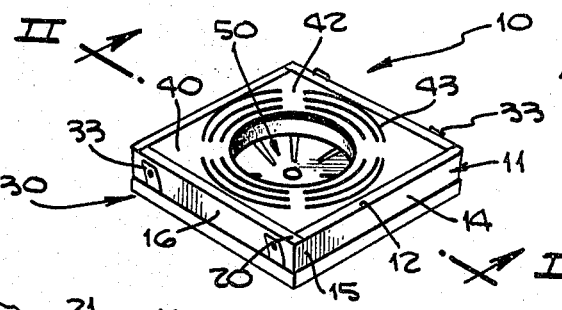
FIG. 1 is a perspective view of an exemplary embodiment of the diffuser of the present invention looking downward at it.

The preferred air diffuser 10 of the present invention includes a perimetric sidewall 11, a perforated bottom wall 30 attached to the bottom of the sidewall and a top wall 40 attached to the top of the sidewall. In the exemplary embodiment, sidewall 11 is formed of sheet metal that is either bent or roll formed into a wide, shallow channel. One margin 12, which will be at the top of the sidewall, is slightly wider than the other margin 13 of the sidewall, which will be at the bottom. The widest portion of the sidewall 14 forms most of the sidewall and connects the top and bottom margins 12 and 13.

The sidewall is folded to form a box-like structure, which in the exemplary embodiment is a square. As is known square, box-like air diffusers are of a dimension where they may be supported on an exposed T-bar ceiling.

Figure 2:
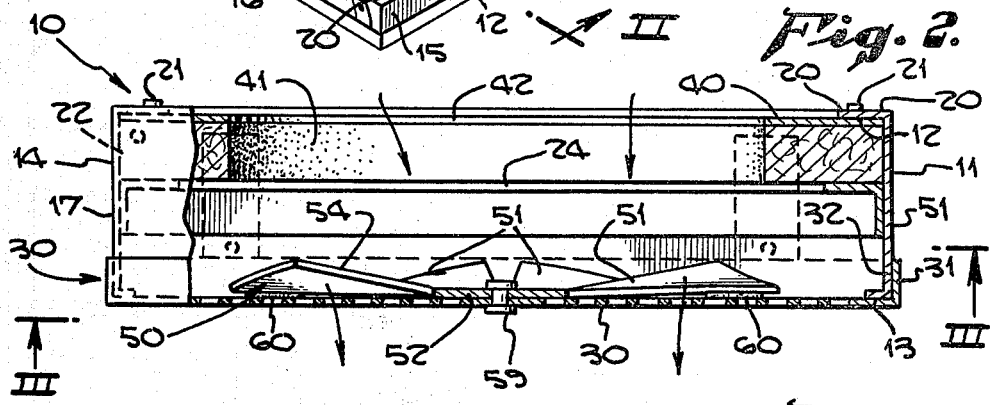
FIG. 2 is a sectional view in elevation of the exemplary embodiment of the present invention through plane II—II in FIG. 1.
Figure 3:
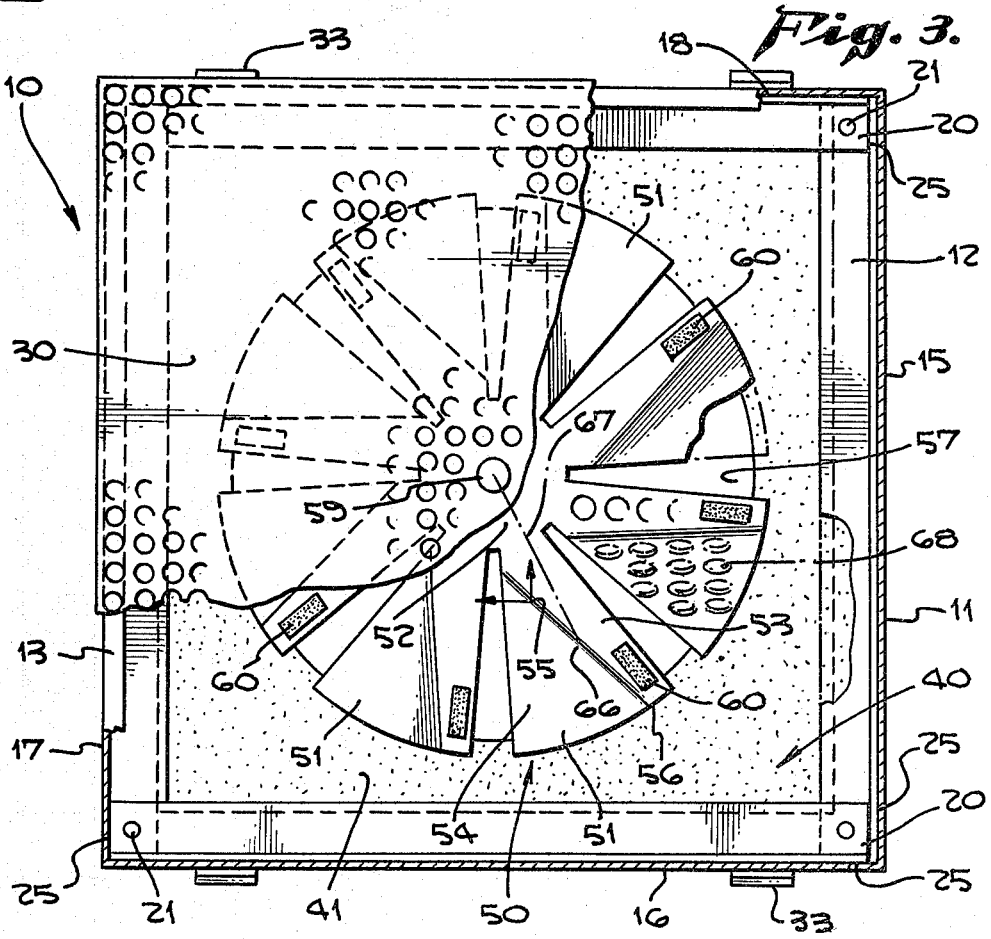
FIG. 3 is a sectional plan view partially broken away through plane III—III of FIG. 2 looking upward from the bottom of the diffuser.

In the exemplary embodiment, the square sidewall is formed as follows. The sheet metal with its roll formed top and bottom margins 12 and 13 is cut along the margins at distances corresponding to the side dimension of the individual sidewall portions 15, 16, 17 and 18 of the entire sidewall 11. The thin sheet metal bends easily once the margins 12 and 13 are cut with the adjacent ends 20 overlapping each other as shown at the corners of FIG. 3 and the upper right corner of FIG. 2. The sheet metal is slightly longer that the perimeter of the sidewall so that at the ends of the sheet metal at portion 17, there is some overlap, and this short overlap 22 is bent under sidewall portion 16 (FIG. 2).

Thereafter, the ends of the top margin that are overlapping each other are riveted at 21 at all four corners. Also, the side edge of the end of the top margin that is folded under its adjacent end rests against the inside of the sidewall, which, in cooperation with the rivet allows for a rigid sidewall structure. It is also noted that air will not leak through the sidewalls at the bends because there is no space for leakage. This includes the intersection with the short overlapping portion 22 and its intersection with sidewall portion 16. This is important in high humidity areas where cold air interjected between the true ceiling and the suspended ceiling might cause condensation that could damage the suspended ceiling or other items housed in that space.

Perforated bottom wall 30 includes bent up portions 31, which need not be perforated. The width of the bottom wall between the bent up portions 31 is slightly greater than the length of a sidewall portion 15–18 so that the sidewall 11 in its box-like configuration can rest on bottom wall 30. The bottom wall 30 is riveted to the various sidewall portions 15–18, perferably through one of the perforations 32. Before riveting, a seismic tab 33 may be inserted between sidewall portion 16 and the bent up portion 31 of bottom wall 30 so that it will also be riveted to the side and bottom wall. The seismic tabs are required by some building codes in areas where earthquakes are a threat, and it allows the diffuser to be more surely secured to the ceiling.

In the exemplary embodiment, the perforated bottom wall is also sheet metal. Each perforation is approximately 3/16 in. (4.8 mm), staggered, and having centers ¼ in. (6.4 mm) apart. This yields a free area of about 51% allowing sufficient air flow but still being structurally rigid. The perforated screen tends to break the large flow of air coming from a duct into smaller streams. These small streams mix quickly with room air to prevent drafts even at relatively high flow rates such as 1 to 1.5 cfm.

Top wall 40 is formed of rigid, insulating material capable of securing ducting to an opening through the material. In the exemplary embodiment, top wall 40 is formed of molded fiberglass 41 with a thin layer of aluminum foil 42 bonded to the fiberglass on its top. The aluminum foil provides better thermal insulation, and also is a surface on which condensation is not as damaging. Moreover, the foil protects the fiberglass from having particles removed during assembly or installation, and it provides a surface on which a stencil can be printed. The stencil may contain product information and a locater guide 43 for locating the opening where the duting is connected.

Along with the location of the opening, the stencil could also have various diameter circles to correspond to various diameter openings for connecting to different size ducting. The installer merely needs a sharp blade to cut through the foil and fiberglass along the desired diameter circle to cut an opening 44 through the fiberglass and into the inside of the diffuser. The duct is connected to the diffuser at the opening by means of a collar, which is not shown.

The top wall is held in place by sandwiching it between the top margins 12 and an L-shaped bracket 24, which is riveted to the sidewall. The bracket adds rigidity to the diffuser.

Air passing through the ducting enters the diffuser where it begins to spread out. In the path of the ducting and the primary air flow, there is a deflector, which is attached to the bottom wall 30 by a suitable connecting means such as rivet 59. The primary purpose of the deflecting means is to deflect air as it exists the diffuser so that it spreads out the air pattern. The deflecting means 50 of the present invention has a plurality of arms 51 extending radially out from central area 52. Each arm has a flat portion 53 generally parallel to the bottom wall and a bent up portion 54 at angle 55 to the flat portion 53. The bend takes place along a line of bending 56 which is at an acute angle 66 (FIG. 3) to a radius 67 from the center of the deflector to the line.

In the exemplary embodiment, the deflector is formed of thin sheet metal. The ends of the arms are not connected to each other leaving a void area 57 between the arms. The deflector may also be formed of perforated metal (as shown in phantom at 68 in FIG. 3) for two reasons. First, the perforations change the air distribution pattern, in part, because some of the air flow that would have been deflected passes through the deflector in small diameter flows. The perforations in the flat portion of the arms could be aligned or alternatively moved out of alignment with the perforations in the bottom wall to form a rotating weir. With an extension or knob connected to the deflector, the deflector could be used to increase or decrease the air flow through the diffuser.

The air pattern is dependent on a number of factors including the diameter of the deflector with respect to the duct diameter, the diameter of the deflector with respect to the size of the diffuser, the void area 57, the size of the arms or blades 51, the pitch or angle 55 of the blade, the height of bent up portion 54, the angle which line 56 makes with the radius, the number of blades, whether the deflector is perforated or not and the spacing between the deflector and the bottom wall.

The deflector is perferably spaced a small thickness from the bottom wall, and the connecting rivet 59 is secured through the central portion of the deflector and a perforation in the bottom wall when it easly passes for fastening the deflector to the bottom wall. Resilient means in the form of tabs 60 are placed between one or more of the arms and the bottom wall to provide a space therebetween. If any vibration occurs in the deflector, the spacing and the resilient tabs 60 prevent the arms from vibrating against the bottom wall.

For ease of assembly, the deflector is attached to the bottom wall before the bottom wall is secured to the sidewall.

Adjusting means may also be provided to adjust the angle that bent up portion 54 makes with flat portion 53. This adjusting means in the exemplary embodiment is intended to be a mere hand adjustment taking place either during assembly, or the installer may adjust the angle after he cuts a hole in the top wall 40. By changing the angle, the flow pattern of air may be modified for different room configurations. Although the diffuser is intended to be a 360° one, a baffle may be inserted in the duct to modify the air flow and make the diffuser a 180° or 270° diffuser.

Although this particular invention has been described in detail with particular reference to the exemplary embodiment, various modifications may be made to it by one skilled in the art and still come within the scope and spirit of the present invention, which is limited only as defined in the claims.

We claim:

1. In an air diffuser having a perimetric sidewall, a perforated bottom wall attached to the bottom of the sidewall and a top wall attached to the top of the side wall forming a box-like structure, the improvement comprising:

deflector means and connecting means for attaching the deflector means to the bottom wall in the diffuser and for deflecting air as it exits the diffuser, the deflector means having a plurality of arms extending radially out from a central area, each arm having a flat portion generally parallel to the bottom wall and a bent up portion for deflecting air, the connecting means comprising a connecting member through the central portion of the deflector means, a perforation in the bottom wall for fastening the deflector means to the bottom wall, and resilient means between a portion of at least one arm and the bottom wall for reducing contact between the arm and the bottom wall and for providing a space therebetween.

2. The diffuser of claim 1, the improvement further comprising the provision of:

the bend of the arms being disposed along an acute angle to a radius from the center of the deflector means to distribute air about the deflector means in a spreading pattern.

3. The diffuser of claim 1, the improvement further comprising the provision of:

adjusting means on the arms of the deflector means for adjusting the angle of the bent up portion with respect to the flat portion.

4. The diffuser of claim 1, the improvement further comprising the provision of perforations through the deflector means for modifying the air flow through the diffuser.

5. The diffuser of claim 4, the improvement further comprising the provision of:

the perforations through the deflector means being in the same pattern as the perforations through the bottom wall whereby selectively aligning and unaligning the perforations on the two members modifies the pattern and amount of air passing through the diffuser.

6. In an air diffuser having a perimetric sidewall, a perforated bottom wall attached to the bottom of the sidewall and a top wall attached to the top of the sidewall forming a box-structure, the improvement comprising:

(a) the top wall comprising rigid, insulating material capable of securing ducting to an opening through the material; and, (b) deflector means and connecting means for attaching the deflector means to the bottom wall in the diffuser and for deflecting air as it exits the diffuser, the deflector means having a plurality of arms extending radially out from a central area, each arm having a flat portion generally parallel to the bottom wall and a bent up portion for deflecting air, the connecting means comprising a connecting member through the central portion of the deflector means, a perforation in the bottom wall for fastening the deflector means to the bottom wall, and resilient means between a portion of at least one arm and the bottom wall for reducing contact between the arm and the bottom wall and for providing a space therebetween.

7. The diffuser of claim 6, the improvement further comprising the provision of:

the sidewalls being formed of sheet metal and the top wall being formed of rigid fiberglass whereby the fiberglass can be cut using standard tools to form an opening for attachment to a duct.

8. The diffuser of claim 7 further comprising a sheet of metal foil on the outside of the fiberglass to prevent particles of the fiberglass from being dislodged therefrom.

9. The diffuser of claim 8 including indicia means on the foil for indicating position of the opening.

* * * * *